US005327960A

United States Patent [19]

Cornette et al.

[11] Patent Number: 5,327,960

[45] Date of Patent: Jul. 12, 1994

[54] GRAVEL PACK INSTALLATIONS FOR WELLS

[75] Inventors: H. Mitchell Cornette, Houston; John V. Salerni, Kingwood; Robert K. Bethel, Houston, all of Tex.

[73] Assignee: Atlantic Richfield Company, Los Angeles, Calif.

[21] Appl. No.: 980,823

[22] Filed: Nov. 24, 1992

[51] Int. Cl.[5] ..... E21B 43/04; E21B 43/08; E21B 34/06

[52] U.S. Cl. ..... 166/51; 166/158; 166/205; 166/227; 166/316; 166/327

[58] Field of Search ..... 166/51, 278, 325, 327, 166/227, 157, 158, 205, 316

[56] References Cited

U.S. PATENT DOCUMENTS

| | | | |
|---|---|---|---|
| Re. 17,206 | 2/1929 | Pivoto | 166/158 |
| 1,839,709 | 1/1932 | Smith | 166/158 X |
| 2,090,545 | 8/1937 | Moore | 175/314 |
| 3,168,924 | 2/1965 | Anderson | 175/314 |
| 3,421,586 | 1/1969 | Solum | 166/51 |
| 3,481,397 | 12/1969 | Baker | 166/327 X |
| 3,850,246 | 11/1974 | Despujols | 166/278 |
| 4,291,722 | 9/1981 | Churchman | 166/325 X |
| 4,729,432 | 3/1988 | Helms | 166/327 X |
| 5,036,920 | 8/1991 | Cornette et al. | 166/278 |

*Primary Examiner*—Hoang C. Dang
*Attorney, Agent, or Firm*—Michael E. Martin

[57] ABSTRACT

A gravel pack screen assembly includes a bit or sub having a flow passage which may accept a wash pipe. The wash pipe may be inserted past a flapper-type closure member which moves to a closed position upon withdrawal of the wash pipe after completion of the installation of the gravel pack assembly. The closure member can be formed of a porous material to permit the flow of liquid through the bit or sub flow passage into the interior of the gravel pack screen but to prevent flow of gravel packing or produced sand into the interior of the screen. The closure member may serve as a backup to a conventional one-way valve and permit additional gravel pack material to be placed in the flow passage upon completion of the gravel pack installation and in the event of early or late failure of the one-way valve.

12 Claims, 2 Drawing Sheets

GRAVEL PACK INSTALLATIONS FOR WELLS

BACKGROUND OF THE INVENTION

Field of the Invention

The present invention pertains to a gravel pack screen assembly wherein an auger bit or tailpipe portion has a passage which is closeable by a permeable check valve closure member, or by a solids flow restricting member, both provided for allowing a sand plug to be established in the passage.

Background

In gravel packed fluid production wells, certain improvements have been made to so-called auger-type gravel pack assemblies including those described in U.S. Pat. No. 5,036,920 issued Aug. 6, 1991 to H. M. Cornette, et al, assigned to the assignee of the present invention, and also including those improvements described in U.S. patent application Ser. No. 07/667,938 and 07/668,003, both filed Mar. 12, 1991 in the name of H. M. Cornette, et al and also assigned to the assignee of the present invention. The gravel pack screen assembly described in U.S. Pat. No. 5,036,920 is provided with a gravel pack bit disposed on the distal end of the auger-type screen which includes a check valve to permit the flow of fluids from a so-called wash pipe disposed within the screen out through passages in the bit and into the wellbore during certain phases of installation of the gravel pack assembly. However, if this check valve should fail after withdrawal of the wash pipe, it is likely that a substantial flow of gravel packing and other earth material might intrude into the interior of the gravel pack screen and be produced by the well, thereby defeating the purpose of the screen.

This check valve cannot be completely eliminated in auger-type gravel pack bit assemblies, as well as certain other types of gravel pack screen installations, because it is necessary to provide for the flow of fluid into the wellbore, preferably directly ahead of the bit assembly or the screen tailpipe or distal sub portion to remove debris which may have accumulated on top of the gravel packing or to provide fluid flow for certain other operations. Such debris is often in the form of a fine silt-like material which has formed as a filter cake or crust on top of the gravel packing in wells which are over-balanced prior to installation of the gravel packing. Other wellbore debris may, of course, accumulate on top of the gravel packing. All of this debris should be washed out and away from the gravel packing prior to installation of the gravel pack assembly. Hence, the provision of the wash pipe and the one-way valve in the distal end of the screen assembly.

The problems associated with failures of check valves in auger type gravel pack bits and other gravel pack screen assemblies are overcome by the present invention.

SUMMARY OF THE INVENTION

The present invention provides improvements in gravel pack screen assemblies, wherein, for example, an auger bit disposed on the distal end of a gravel pack screen is provided with spaced-apart, one-way or so called check valves disposed in a passage in the bit to provide for the accumulation of a sand plug in such passage in the event of failure of one or both of the check valves. The check valves may also permit insertion of a wash pipe into the bit for washing debris out of the wellbore during installation of the gravel pack screen while preventing reverse flow of debris and gravel packing into the interior of the gravel pack screen after withdrawal of the wash pipe.

In accordance with one important aspect of the present invention an auger-type gravel pack bit for use in an auger gravel pack screen assembly is modified to include a backup check valve which has a flapper-type closure member which is permeable to liquid flow when closed but prevents the flow of wellbore solids material, including gravel packing, into the interior of the gravel pack screen attached to the bit. The permeable check valve is provided as a backup check valve to a conventional one-way valve installed in the distal end of the bit.

The improved arrangement provides for insertion of a wash pipe into the interior of the gravel pack screen assembly, including at least a portion of the bit, for injection of liquids through the distal end of the bit to wash away debris and filter cake material accumulated on top of a gravel packing prior to installation of an auger gravel pack assembly.

In accordance with yet a further aspect of the present invention, a gravel pack screen assembly is provided with a bit end or sub member which includes check valves arranged in such a way that, in the event of early or delayed failure of a primary check valve, a secondary check valve is operable to prevent intrusion of solids material into the interior of the gravel pack screen while permitting fluid flow into and through the interior of the screen. In this way, in effect, additional gravel packing is operable to perform its intended function and is disposed in a flow passage in the gravel pack bit or sub, which flow passage would otherwise not be operable after completion of installation of the gravel pack assembly.

Those skilled in the art will further appreciate the advantages and benefits of the present invention together with other superior aspects thereof upon reading the detailed description which follows in conjunction with the drawing.

DESCRIPTION OF PREFERRED EMBODIMENTS

Figure 1:
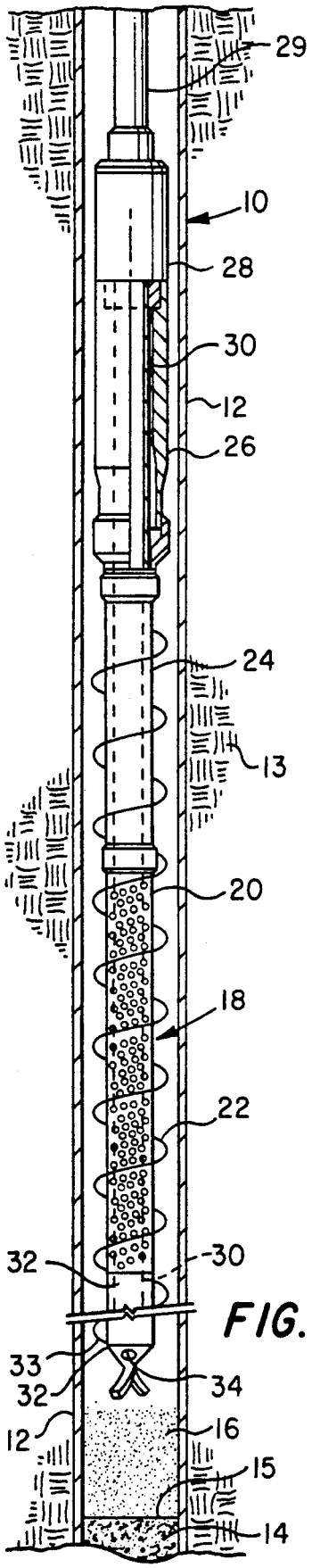
FIG. 1 is a vertical longitudinal central section view of a portion of a wellbore into which an auger-type gravel pack assembly in accordance with the present invention is being installed.

In the description which follows like parts are marked throughout the specification and drawing with the same reference numerals, respectively. The drawing figures are not necessarily to scale in the interest of clarity and conciseness.

Referring to FIG. 1, there is illustrated a portion of a fluid production well, generally designated by the numeral 10, which includes a suitable casing 12 the lower portion of which, shown in the drawing figure, has been pre-packed with a gravel packing 14 of a conventional type. The well 10 extends within an earth formation 13. The gravel packing 14, as is known to those skilled in the art, will serve as a filter media to prevent the production of solids particles from a fluid producing zone in the formation 13 up through the wellbore upon completion of the well. The gravel packing 14 is pre-installed in accordance with a preferred method of completing a well, wherein after installation of the gravel packing a tubular gravel pack screen is installed in the gravel packing by augering the screen assembly into its final position. In this regard certain improvements have been made in so-called auger-type gravel pack screens, such as those disclosed in U.S. Pat. No. 5,036,920.

Typically, in installing an auger-type gravel pack screen, certain problems arise in that, during the placement of the gravel packing and subsequent to that event, there occurs an accumulation of debris of filter cake, designated by the numeral 16 in FIG. 1, on top of the gravel packing. This debris may comprise a substantial accumulation of fine, silt-like particles which are disposed in the well and which tend to flow down and through the gravel packing out into the formation zone to be produced during completion of the well, particularly when a column of fluid in the well creates an over-balanced pressure condition. Such a condition is when fluid flow tends to move from the wellbore out into the formation zone of interest. In any event it is often the case that an accumulation of material 16 occurs on top of the gravel packing 14 prior to installation of the gravel pack screen and this material should be removed by the injection of fluid into the wellbore to effect entrainment of this material in flow which proceeds up the wellbore annulus to thereby wash it off of the top surface 15 of the gravel packing.

FIG. 1 further illustrates an auger-type gravel pack screen assembly, generally designated by the numeral 18 in the process of being installed in the gravel packing 14. The screen assembly 18 is similar to that described in U.S. Pat. No. 5,036,920 and except for the improvements described herein is of a type commercially available from Baker Sand Control Division Baker Hughes Inc., Houston, Tex. The gravel pack screen assembly 18 includes a generally tubular auger gravel pack screen 20 such as a Bakerbond Auger Slimpack Screen available from Baker Sand Control. The gravel pack screen 20 includes at least one helical auger flight 22 formed thereon and extending substantially continuously over the screen and a blank pipe section 24 suitably connected to the upper end of the screen 20. The screen assembly 18 typically also includes a so-called hook-up nipple or pipe section 26 extending upward in the well 10 from the blank pipe and screen assembly. The hook-up nipple 26 is adapted to be releasably connected to a suitable running tool 28 for installing the screen assembly 18 into the gravel packing 14. The running tool 28 is, in turn, suitably connected to a generally tubular work string 29 which extends to the surface, not shown, and is connected to suitable running gear, also not shown, for installing the screen in accordance with methods known to those skilled in the art of auger-type gravel pack screen installations.

The running tool 28 is also of a type commercially available from Baker Sand Control Division and includes a portion which is connected to an elongated tubular wash pipe member 30 which extends within the assembly of the hook-up nipple 26, the blank pipe section 24 and the screen 20. The tubular member 30, in fact, extends downward through the screen 20 and into the interior of an elongated member 32 which is threadedly connected to the distal end of the screen 20 and is commonly referred to as a gravel pack bit. The bit 32 is also provided with a helical auger flight 33 comprising, in effect, a continuation of the auger flight 22. As shown in FIG. 1 the tubular wash pipe 30 extends down into the interior of the bit 32 for conducting fluid through the bit 32 and to exit the lower end of the bit through one or more passages 34, see FIGS. 1 and 2.

Figure 2:
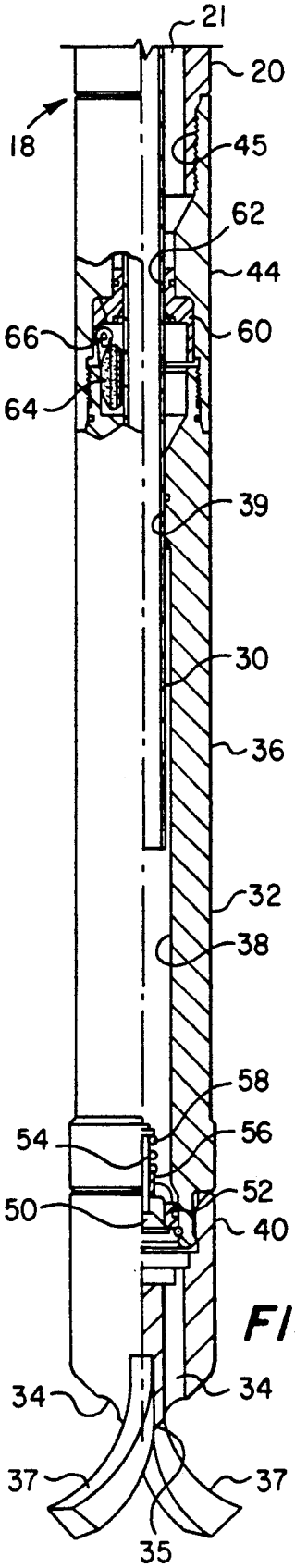
FIG. 2 is a vertical longitudinal central section view of an improved auger gravel pack bit in accordance with the present invention.

Referring now primarily to FIG. 2, the bit 32 includes a main body comprising an elongated tubular member 36 having a longitudinal, central flow passage 38 extending therethrough. The body 36 is threadedly connected to a separable sub part 40 which includes the passages 34 formed therein through which cleaning fluid may exit the lower distal end 35 of the bit 32. Suitable lead or pilot auger elements 37 are shown on the sub 40 and aid in piloting the auger 22 as it enters the gravel packing 14.

The bit 32 also includes a second sub 44 threadedly connected to the upper end of the body 36 and provided with a suitable box end 45 for connecting the bit to the gravel pack screen 20 in a conventional manner. As shown in FIG. 2 also, the body 36 defines a reduced diameter passage portion 39 of the passage 38 which is disposed in close proximity and substantially fluid sealing relationship with the wash pipe 30. Suitable seal means, not shown, may be disposed in the bore forming the passage 39 to further minimize leakage of fluid upward through the passage 38 and into the interior 21 of the gravel pack screen 20.

As shown also in FIG. 2, the bit 32 is provided with a poppet type one-way flow control valve including a closure member 50 which rests against a seat 52. The closure member 50 is of a conventional poppet type having a stem portion 54 which extends through the seat 52 including its stem retaining portion 56. A coil spring 58 biases the closure member 50 against the seat 52.

In normal operation to install the gravel pack screen 18, as the screen assembly is lowered into the position shown in FIG. 1 by the work string 30, pressure fluid is conducted down through the work string, the wash pipe 30, and through the passage 38 to bias the valve 50 in the open position so that fluid may flow out through the passages 34 to wash debris 16 off of the gravel packing 14. This debris may be entrained by the fluid flow such that it flows up through the annulus formed in the casing 12 between the casing and the work string 29 and gravel pack assembly 18. This washing action is normally ceased just as the gravel pack screen and bit assembly 18 enter the gravel packing 14, although the washing may continue during installation to fluidize the gravel packing and make the gravel pack installation easier to complete.

Upon completion of installation if the valve closure member 50 should remain stuck in the open position due to contamination or mechanical failure, or if the valve should fail later in life due to fatigue or corrosion induced failure, fluid produced from the earth formation 13 may flow through the gravel pack 14 and up through the passage 38 and carry gravel packing and other earth material with it, thereby defeating the function of the gravel pack 14 and the screen 20. In order to alleviate the likelihood of this unwanted occurrence and to also provide an improved gravel pack screen assembly, a second or back-up check valve is provided in the bit 32 comprising a seat member 60, FIG. 2, which is disposed in the sub 44 and includes a central passage 62 formed therein to permit extension of the wash pipe 30 therethrough and into the passage 38, 39. The seat 60 supports a closure member 64 of the so-called flapper-type which is mounted on suitable pivot means 66 secured on the seat 60 and operable to permit movement of the member 64 between an open position shown in FIG. 2 and a closed position in engagement with the seat 60 and closing over the passage 62.

The closure member 64 may be of unique configuration in that it is preferably made of a permeable material such as a sintered metal or the like. Alternatively, as described hereinbelow, the closure member may be modified to have a foraminous insert added thereto. In any event, closure member 64 is permeable to fluid flow but substantially prevents the flow of gravel packing sand and other solids therethrough. In other words, the closure member 64 functions in some ways similar to the gravel packing 14. The closure member 64 is preferably supported on the pivot means 66 to be biased to the closed position in engagement with the seat 60. Suitable coil spring means, not shown, may be associated with the pivot means 66 in a conventional manner to provide for pivoting the closure member 64 from the open position shown in FIG. 2 to a closed position in engagement with the seat 60 when the wash pipe 30 is removed from the body 36. Thanks to the provision of permeable material, such as sintered metal or the like, forming the closure member 64, if the closure member 50 fails to completely close when the gravel pack assembly 18 is installed in the well 10 the closure member 64, which is in a more protected environment away from wellbore debris, will move to a closed position upon removal of the wash pipe 30 to permit fluid flow up through the passage 38, 39 and into the interior 21 of the screen 20 but will substantially prevent the flow of solids particles such as gravel packing sand into the screen interior. Gravel packing 14 will, of course, fill the passage 38, 39 to actually increase the amount of flow area for fluid which is subject to the filtering action of the gravel packing as it flows toward the interior 21 of the screen 20 from any direction. The packing 14 may also form a "plug" having enough frictional resistance to movement out of the passage 38, 39 even in the event of later failure or disintegration of the closure member 64.

Other than the material specified for the closure member 64 the components of the bit 32 may be made from conventional materials used for down hole well tools and the like. Moreover, the other components of the gravel pack assembly 18 may be made from conventional materials for such elements and known to those skilled in the art of well completion engineering.

The operation of installing the gravel pack screen assembly 18 includes lowering the assembly as it exists in the condition of FIG. 1 into the well 10 on the work string 29 and injecting wash liquid down through the work string 29, the running tool 28 and the wash pipe 30 to cause the wash liquid to exit the ports 34 in the bit 32 and effect removal of the debris 16 from the top of the gravel packing 14. Typically, the wash liquid is injected during installation of the gravel pack screen assembly 18 or the wash pipe 30 is at least left in assembly with the screen assembly during augering of the screen 20 into the gravel packing 14.

Once the screen 20 is augered into its final working position the running tool 28 is disconnected from the hook-up nipple 26 and together with the wash pipe 30 is withdrawn from the well 10 by the work string 28. Upon withdrawal of the wash pipe 30 from the bit 32 the closure member 64 will move to a closed position in engagement with the seat 60 to substantially prevent the flow of solids materials up into the interior 21 of the screen 20 by way of the passage 38, 39 and 62 in the event of failure of the closure member 50 to completely close to a fluid tight position. Alternatively, in some installations, the one-way valve 50 may be eliminated. Thanks to the provision of the permeable closure member 64, in the event of failure of the closure member 50, or lack of its presence, gravel packing may be carried by fluid flow into the passage 38, 39 to pack against the closure member 64 and allow liquid to flow through the closure member 64 and into the interior 21 of the screen 20 to be produced up out of the well by a suitable tubing string, not shown, connected to the hook-up nipple 26 in a conventional manner. Alternatively, the work string 29 may remain connected to the gravel pack assembly 18.

Figure 3:
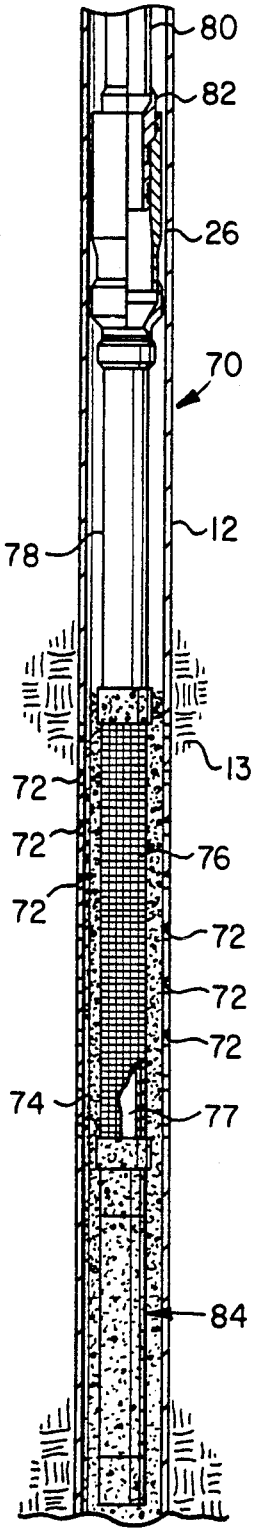
FIG. 3 is a longitudinal central section view of a portion of a wellbore showing an alternate embodiment of a gravel pack screen assembly in accordance with the present invention.
Figure 4:
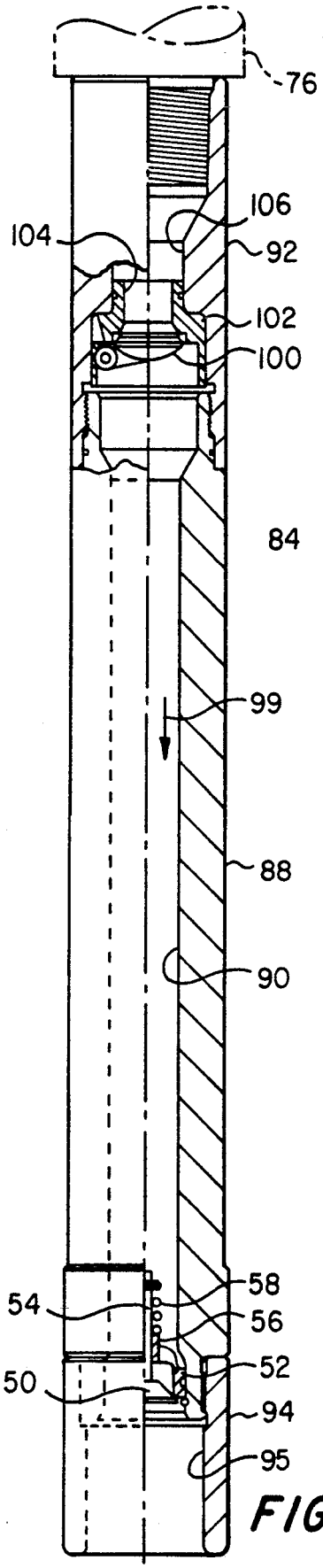
FIG. 4 is a vertical longitudinal central section view of a sub or tailpipe portion of the screen assembly of FIG. 3.
Figure 5:
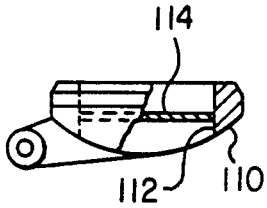
FIG. 5 is a detail view of a flapper type closure valve modified for use in accordance with the screen assemblies of the present invention.

Referring now to FIGS. 3, 4 and 5, there is illustrated a well 70 with a conventional casing 12 interposed therein and perforated at 72 to permit flow of production fluids from a formation 13 into wellbore 74 which has been gravel packed around a conventional gravel pack screen 76 having an interior flow passage 77. The screen 76 is interposed in an assembly which includes a blank pipe section 78, a hook-up nipple 26 and a tubing string or completion assembly 80 which includes a locator seal assembly 82 connected to the hook-up nipple 26. The distal end of the gravel pack screen assembly includes a tailpipe or sub 84 connected to the screen 76 and which will be further described in conjunction with FIG. 4. The gravel pack screen assembly illustrated in FIG. 3 is in the condition wherein the running tool and wash pipe assembly, if used, has been withdrawn from the well and the completion string or tubing 80 has been installed connected to the gravel pack screen 76 via the base pipe 78 so that wellbore fluids may be produced through the screen and up through the tubing string in a conventional manner.

Referring now to FIG. 4, the tailpipe or sub 84 is a multi-part assembly including an intermediate sub 88 having a flow passage 90 formed therein and connected at its opposite ends to respective subs 92 and 94. A poppet type check valve 50 having a seat assembly 52 is interposed in the sub 88 in a manner similar to the arrangement of the poppet check valve in the bit 32. The valve closure member 50 also includes a stem portion 54 which passes through a seat stem retaining portion 56 and is engaged by coil spring 58.

A second one-way or check valve is interposed in the sub 84 and spaced from the closure member 50 as shown in FIG. 4. The second check valve is of the pivotally supported flapper type including a closure member 100 pivotally supported on a seat assembly 102, similar to the seat 60 and disposed in the sub 92. The closure member 100 is intermediate the screen 76 and the valve 50 and is adapted to close off a flow passage 104 which is in communication with a bore 106 in the sub 92. Accordingly, fluid may flow down through the screen assembly including the blank pipe 78, the gravel pack screen 76 and the flow passages 104, 106 and 90, and a flow passage 95 in the sub 94 to exit the lower end of the sub 84. A suitable wash pipe, not shown, may also be inserted into the sub 84 in the same manner that the wash pipe 30 is inserted into the bit 32. The closure member 100 is spring biased into the closed position shown but may be displaced into an open position by pressure fluid acting thereon or by insertion of the above-mentioned wash pipe. The closure member 100 may be of a non-permeable material and of conventional construction for wellbore flapper-type check valves. Alternatively, as shown in FIG. 5, a closure member 110 may be substituted for the closure member 100, having a central bore 112 formed therein and a foraminous screen-like member 114 interposed in the bore to permit fluid flow through the closure member 110 but to substantially prevent solids from flowing through the closure member, when it is in the position shown for the closure member 100 in FIG. 4. The closure member 110 may be substituted for the closure member 100 or the closure member 64 in the embodiment of FIGS. 1 and 2.

As previously discussed, provision of the spaced-apart redundant check valves 50 and 100 (or the closure member 110) in the sub 84 prevents fluid flow in the direction opposite the arrow 99, FIG. 4. However, should the closure member 50 fail in some manner, be jammed open, or eventually disintegrate from corrosion, fluid and solids material may flow into the passage 90 but be prevented from flowing into the interior of the screen 76 by the closure member 100. If a closure member 110 or a closure member 64 is substituted for the closure member 100, fluid may readily flow into the passage 77 of screen 76 from the sub 84 but any gravel or other solids packed in the wellbore 74 will be trapped in the passage 90 below the closure member 100 or its substitute, viewing FIG. 4. It is likely that the closure member 50 will fail before the closure member 100 or any substitute closure member previously discussed will fail from corrosion, in particular. In this way, gravel packing may accumulate in the passage 90 and become relatively tightly packed therein to perform its filtering function in the event that the closure member 100 should completely fail or disintegrate.

If a closure member 110 or 64 is used, then fluid is allowed to flow through the passage 90 in the direction opposite the arrow 99 any time the closure member 50 ceases to perform its function. If desired, the closure member 50 may be eliminated and reliance placed on the closure members 100, 110 or 64 to allow accumulation of a gravel packing in the passage 90 or the passage 38 of the bit 32. Even if the closure members 64, 100 or 110 eventually disintegrate or substantially fail to the point where solids would likely pass up into the interior of the gravel pack screens, the accumulation of gravel packing in the passages 38 or 90 will form a relatively tight, immovable plug which will function as a fluid filter but which will not disintegrate or be washed out of the flow passages in the bit 32 or the sub 84 which is distal of the gravel pack completion assemblies described hereinabove.

Materials used for the embodiment of the invention described in conjunction with FIGS. 3 through 5 may be those which are used in conventional wellbore structures. The foraminous member 114 may also be formed of sintered metal or other screen-like structures having a mesh size which will prevent the flow of gravel packing therethrough but which will, of course, allow fluid flow therethrough even in the closed position.

Although preferred embodiments of the present invention have been described in detail herein those skilled in the art will recognize that various substitutions and modifications may be made to the gravel pack screen assemblies of the present invention without departing from the scope and spirit of the appended claims.

What is claimed is:

1. In a gravel pack screen assembly including an elongated gravel pack screen, a member connected to a distal end of said gravel pack screen including a flow passage formed therein and spaced-apart one-way valves interposed in said flow passage, said one-way valves being operable to permit fluid flow in a direction out of a distal end of said member through said flow passage and to substantially prevent the flow of fluid and entrained solids into the interior of said gravel pack screen, and one of said one-way valves is intermediate said gravel pack screen and the other of said one-way valves and includes a closure member having means operable to permit fluid flow through said closure member but to prevent solids flow through said closure member in its closed position whereby, in the event of failure of said other of said one-way valves, a gravel plug may accumulate in said flow passage to filter fluid flow through said flow passage and into the interior of said gravel pack screen.

2. The invention set forth in claim 1 wherein:

said closure member includes a foraminous member interposed therein.

3. The invention set forth in claim 1 wherein:

said closure member is formed of a permeable material.

4. The invention set forth in claim 3 wherein:

said permeable material is sintered metal.

5. In a gravel pack screen assembly for installation in a gravel packing in a well, a gravel pack screen and an elongated member connected to said screen at a distal end thereof, said member including a flow passage formed therein and a one-way valve interposed in said flow passage and including a closure member characterized by means forming a fluid-permeable portion of said closure member to permit flow of fluid from said wellbore into the interior of said screen through said flow passage but to substantially prevent the flow of solids entrained in said fluid so as to allow the accumulation of particulate solids in said flow passage to function as a gravel packing during production of fluid from said well.

6. The invention set forth in claim 5 wherein:

said closure member is a flapper pivotally supported on said member and in said flow passage for movement to an open position to permit insertion of a wash pipe or the like into said member and said flow passage.

7. In a bit for an auger gravel pack screen for installing said screen in a gravel packing in a well wherein said bit has an elongated generally tubular body including a flow passage therein, the improvement characterized by:

a permeable valve closure member supported in said body and movable between open and closed positions, said closure member being movable to an open position to permit insertion of a wash pipe into said bit for communicating wash fluid through said passage, said closure member being movable to a closed position upon removal of said wash pipe from said body to permit flow of liquid through said passage but to substantially block solids particles from flowing through said passage to the interior of said screen.

8. The improvement set forth in claim 7 wherein: said closure member comprises a flapper-type closure member pivotally supported on said body for movement between said open and closed positions.

9. The improvement set forth in claim 7 wherein: said closure member is formed of a porous material.

10. The improvement set forth in claim 9 wherein: said porous material comprises sintered metal.

11. The improvement set forth in claim 7 wherein: said bit includes a second valve closure member interposed in said passage to prevent flow of material into said passage from a distal end of said bit.

12. In a bit for an auger gravel pack screen for installing said screen in a gravel packing in a well wherein said bit has an elongated generally tubular body including a flow passage therein, the improvement characterized by:

a permeable valve closure member pivotally supported in said body and movable between open and closed positions, said closure member being held in an open position by a wash pipe disposed in said bit for communicating wash fluid through said passage, said closure member being movable to a closed position upon removal of said wash pipe from said body to permit flow of liquid through said passage but to substantially block solids particles from flowing through said passage to the interior of said screen.

* * * * *